United States Patent [19]

Goetschius

[11] 4,444,724

[45] Apr. 24, 1984

[54] FUME INCINERATOR WITH GAS COOLED BURNER

[75] Inventor: George W. Goetschius, Wellsville, N.Y.

[73] Assignee: The Air Preheater Company, Inc., Wellsville, N.Y.

[21] Appl. No.: 365,122

[22] Filed: Apr. 5, 1982

[51] Int. Cl.[3] ..... F01N 3/02

[52] U.S. Cl. ..... 422/173; 422/183

[58] Field of Search ..... 422/173, 182, 183; 48/200; 239/132.3, 128

[56] References Cited

U.S. PATENT DOCUMENTS

| | | | |
|---|---|---|---|
| 2,941,587 | 6/1960 | Hagy et al. | 239/132.3 |
| 3,251,656 | 5/1966 | Edwards | 422/183 |
| 4,257,782 | 3/1981 | Woodmanser | 48/200 |

*Primary Examiner*—Peter F. Kratz

*Attorney, Agent, or Firm*—William W. Habelt

[57] ABSTRACT

A fume incinerator (10) wherein the off gas (1) from an industrial process is incinerated to eliminate obnoxious fumes contained therein. The process gas stream (1) is first preheated and then passed over and through an array of burner assemblies (30) disposed within the preheated process gas stream (3). Fuel gas is supplied to the burners (30) and combusted therein to incinerate the process gas stream. The fuel gas is shielded from the preheated process gas (3) stream by passing a cooling gas over the surface of the fuel gas supply conduits (34) to each of the burners (30) in order to prevent overheating and consequent coking of the fuel gas in the supply conduit (34).

1 Claim, 3 Drawing Figures

FUME INCINERATOR WITH GAS COOLED BURNER

The present invention relates to the incineration of obnoxious fumes contained in process gas streams, and more particularly, to a gas-cooled burner assembly adapted for incinerating a high temperature process gas stream flowing past the burner assembly to eliminate obnoxious fumes contained within the process gas stream before the process gas stream is vented to the atmosphere.

The use of fume incinerators for combusting the off gases of various industrial processes in order to incinerate and eliminate obnoxious fumes contained therein is well known in the prior art. In one type of fume incinerator commonly utilized for this purpose, the process gas stream to be incinerated is first preheated by being passed in heat exchange relationship with the combustion products of the fume incinerator as the process gas stream is being passed to the burners of the fume incinerator. By preheating the process gas stream prior to combustion, the overall efficiency of the combustion process is increased and the amount of fuel gas consumed in the combustion of the process gas stream is reduced. In U.S. Pat. Nos. 3,251,656, 3,353,919 and 3,607,118 show fume incinerating apparatus of this type.

In order to incinerate the typical process gas stream, it is necessary to provide a fuel gas to the incinerator for establishing a flame front through which the process gas stream is passed in order to destroy any obnoxious fumes contained therein. It is also necessary that all of the process gas stream pass through the flame front or be thoroughly mixed with fuel gas prior to establishment of the flame front in order to insure efficient elimination of obnoxious fumes contained in the process stream. Additionally, as the process stream frequently also serves as the source of oxygen for combustion of the fuel gas, good mixing between the fuel gas and the process gas stream must occur. Therefore, much effort was expanded in the prior art to develop a burner assembly which insures that the process gas stream thoroughly mixes with the fuel gas being supplied to the incinerator and passes through the flame front generated by the combustion of the fuel gas in the process gas stream.

A particularly successful burner assembly for incinerating process gas streams is disclosed in U.S. Pat. No. 3,051,464 and reissue 25,626 thereof and also in U.S. Pat. No. 3,297,259. As disclosed therein, the burner assembly comprises an axially elongated fuel gas supply conduit which extends transverse to the direction of flow of the process gas stream and has an elongated forward wall facing downstream with respect to the flow of the process gas stream. The forward wall of the fuel gas supply conduit has a number of fuel injection ports along its length through which fuel gas is injected into the process gas stream. Mixing plates extend forwardly from adjacent the sides of the fuel gas supplied conduit in spaced relationship along opposite sides of the fuel gas injection ports and thence extend obliquely outward and forward in divergent relationship at an acute angle so as to define a forwardly, widening trough-shaped mixing space therebetween adjacent and immediately downstream of the fuel gas injection ports. The mixing plates have a plurality of apertures therein through which the process gas stream flowing past the burner assembly is directed into the trough-shaped mixing space to mix with the fuel gas being supplied through the fuel gas injection ports and pass through the flame front established by combustion of the fuel gas in the trough-shaped space.

Although this type of burner has proven quite successful in insuring proper mixture of the process gas stream and the fuel gas and incineration of the obnoxious fumes contained within the process gas stream, a problem has arisen when this type of burner has been utilized in the type of fume incinerators described hereinbefore where the process gas stream is preheated prior to combustion. As the preheated process gas stream flows past the burner assembly to be mixed with the fuel gas and combusted, the preheated fuel gas passes around and over the surface of the gas supply conduit. As it passes over the surface of the gas supply conduit, the preheated fuel gas transfers some of its heat to the gas supply conduit causing the gas supply conduit to heat up. As the gas supply conduit heats up, the fuel gas flowing therethrough also experience a temperature rise. This temperature rise has, in instances of high preheat of the process gas stream, resulted in cracking and/or partial combustion of the fuel gas as it passes through the gas supply conduit thereby causing a buildup of soot in the gas supply conduit. Additionally, soot buildup has also occured at the fuel gas injection ports in the walls of gas supplied conduit resulting in plugging of the fuel gas injection ports.

It is therefore an object of the present invention to provide an improved burner assembly substantially of the type described hereinbefore wherein the fuel gas being supplied to the burner is shielded from the preheated process gas stream to prevent coking and combustion within the fuel gas supply conduit.

SUMMARY OF THE INVENTION

In accordance with the present invention, an axially elongated cooling gas conduit is disposed in spaced relationship along the fuel gas conduit with its major axis lying parallel to the major axis of the fuel gas conduit so as to define therebetween a cooling gas flow passage along the length of the fuel gas conduit whereby the fuel gas traversing the fuel gas conduit is shielded from the high temperature process gas stream flowing past the burner assembly by the cooling gas flowing through the flow passage between cooling gas conduit and the fuel gas conduit. The cooling may be ambient air or unpreheated process gas.

When embodied in a fume incinerator the type described hereinbefore wherein the process gas to be incinerated is preheated, it is preferred to utilize unpreheated gas from the process gas stream as the cooling gas. Therefore, further in accordance with the present invention, means are provided for supplying process gas from a point upstream of the inlet to the heat exchange means associated with the fume incinerator to the cooling gas flow passage of the burner assembly. Further, means are provided for exhausting the unpreheated process gas supplied to the cooling gas flow passage of the burner assembly back into the process gas stream being supplied to the fume incinerator at a point upstream of the burner assembly for subsequent incineration in the combustion chamber of the fume incinerator.

DESCRIPTION OF A PREFERRED EMBODIMENT

Figure 1:
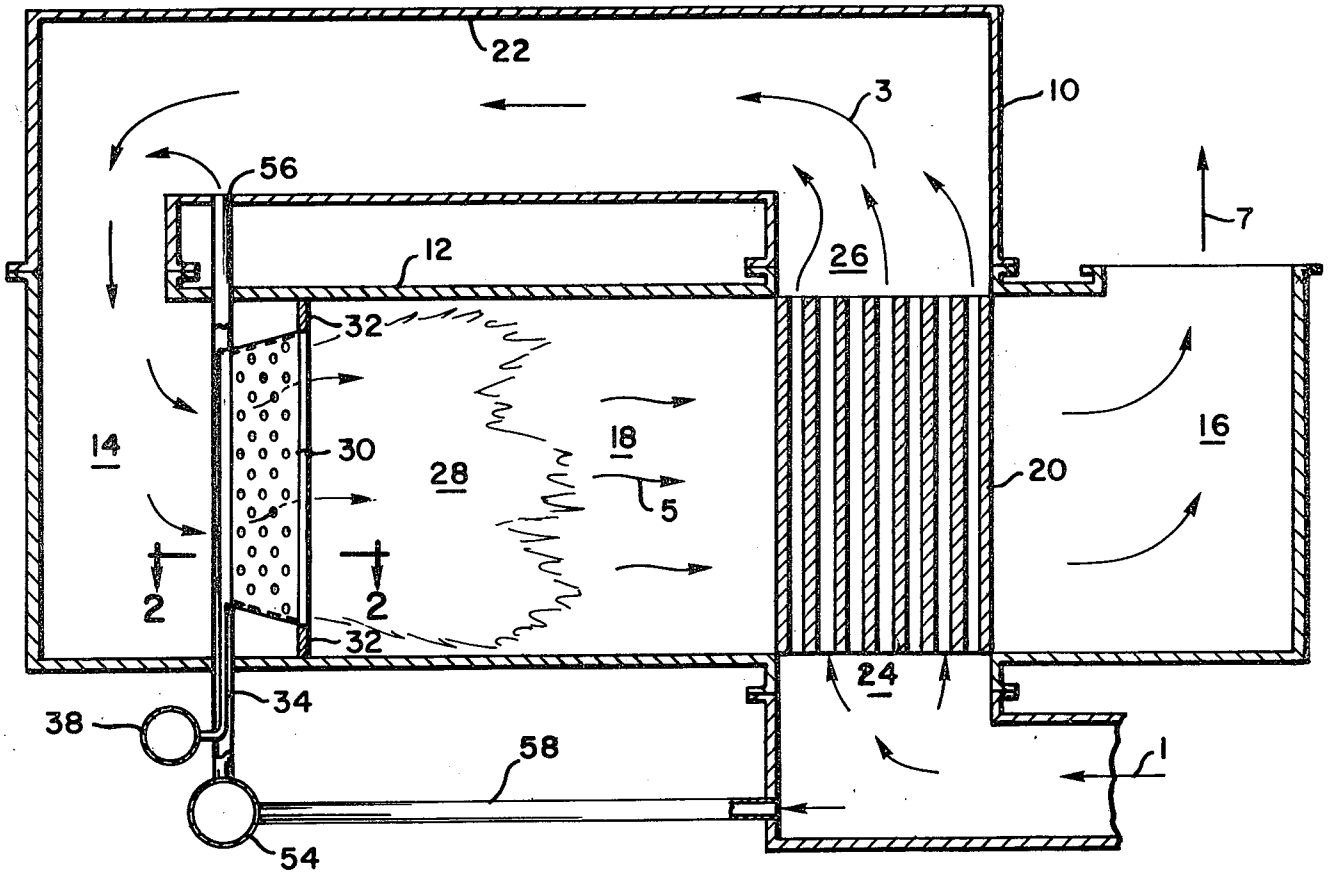
FIG. 1 is a side elevational view of a direct flame fume incinerator incorporating the burner assembly of the present invention.

Referring now to the drawing, and more particularly to FIG. 1 thereof, there is depicted therein a fume incinerator 10 of the type wherein the off gas 1 from an industrial process, hereinafter referred to as the process gas stream, is preheated by being passed in heat exchange relationship with the hot combustion products of the incinerator 10 prior to being combusted in the incinerator 10. The fume incinerator 10 is comprised of a housing 12 enclosing and defining a gas inlet plenum 14, a gas outlet plenum 16, and a combustion chamber 18 therebetween. Additionally, heat exchange means 20 is disposed within the gas outlet plenum 16. Duct means 22 interconnects the outlet of the heat exchange means 20 with the gas inlet plenum 14.

The process gas stream 1 containing the obnoxious fumes to be incinerated in the combustion chamber 18 is first passed to the incinerator 10 through the inlet 24 to the heat exchange means 20. As the process gas stream 1 traverses the heat exchange means 20, it is passed in indirect heat exchange relationship with the incinerated process gas 5 leaving the combustion chamber 18. The process gas 1 is thereby preheated whereby combustion efficiency is increased and the amount of fuel gas required to incinerate the process stream is decreased. The preheated process gas stream 3 passes from the heat exchange means 20 through outlet 26 thereof to a gas duct 22. The gas duct 22 interconnects the outlet 26 of the heat exchange means 20 with the gas inlet plenum 14. The preheated process gas stream 3 supplied to the gas inlet plenum 14 then passes over a plurality of burner assemblies 30 disposed between the gas inlet plenum 14 and the combustion chamber 18 of the incinerator 10.

The preheated process gas stream 3 upon entering the combustion chamber 18 through an array of burner assemblies 30 is incinerated in the flame 28 thereby eliminating any obnoxious fumes contained in the process gas stream. As mentioned previously, the incinerated process gas 5 is passed through heat exchange means 20 in indirect heat exchange relationship with the process gas stream 1 being supplied to the incinerator so as to preheat the process gas stream being supplied to the incinerator and cool the incinerated process gas 5. The cool, incinerated process gas 7 then passes from the gas outlet plenum 16 and is vented to the atmosphere through a stack (not shown).

Figure 2:
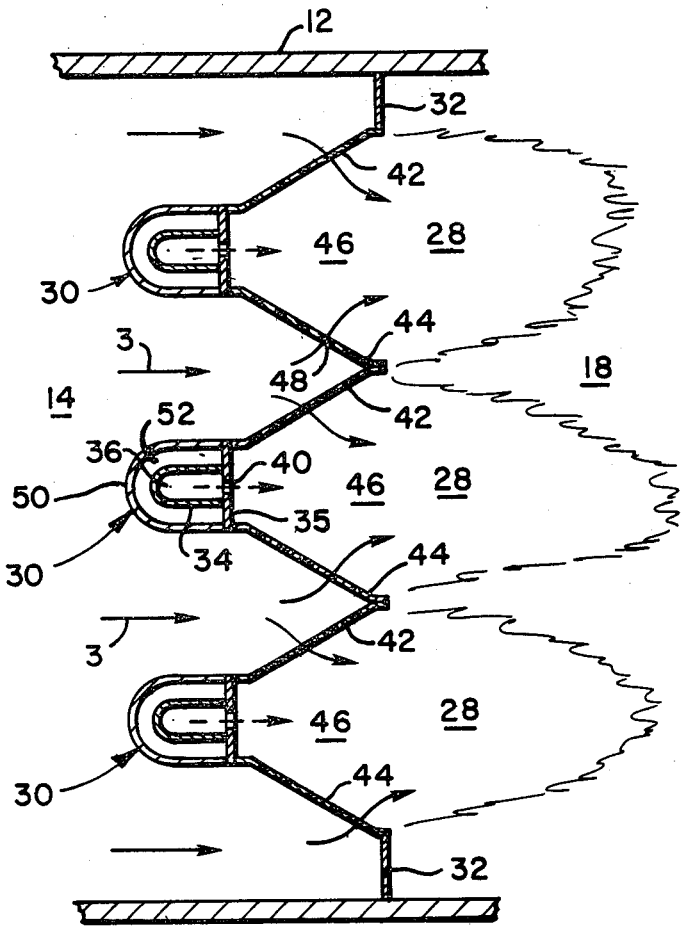
FIG. 2 is a cross sectional view taken along line 2—2 of FIG. 1 showing a plurality of burner assemblies of the present invention in a cross-sectional plan view.

As best seen in FIG. 2, an array of burner assemblies 30 arranged in side-by-side relationship is disposed at the outlet of the gas inlet plenum 14 and the inlet to the combustion chamber 18. Each of the burner assemblies 30, typically termed a line burner, produces a flame 28 in a substantially continuous line along the length of each burner assembly. The preheated process gas stream 3 passes over and through the burner assemblies 30 to be incinerated in the flames 28 associated with the various burner assemblies. Defector plates 32 disposed along the outboard sides and the top and the bottom of the burner array, between the burner array and the incinerator housing 12, insure that all of the process gas stream must pass through the burner array into the flames 28 for incineration.

Figure 3:
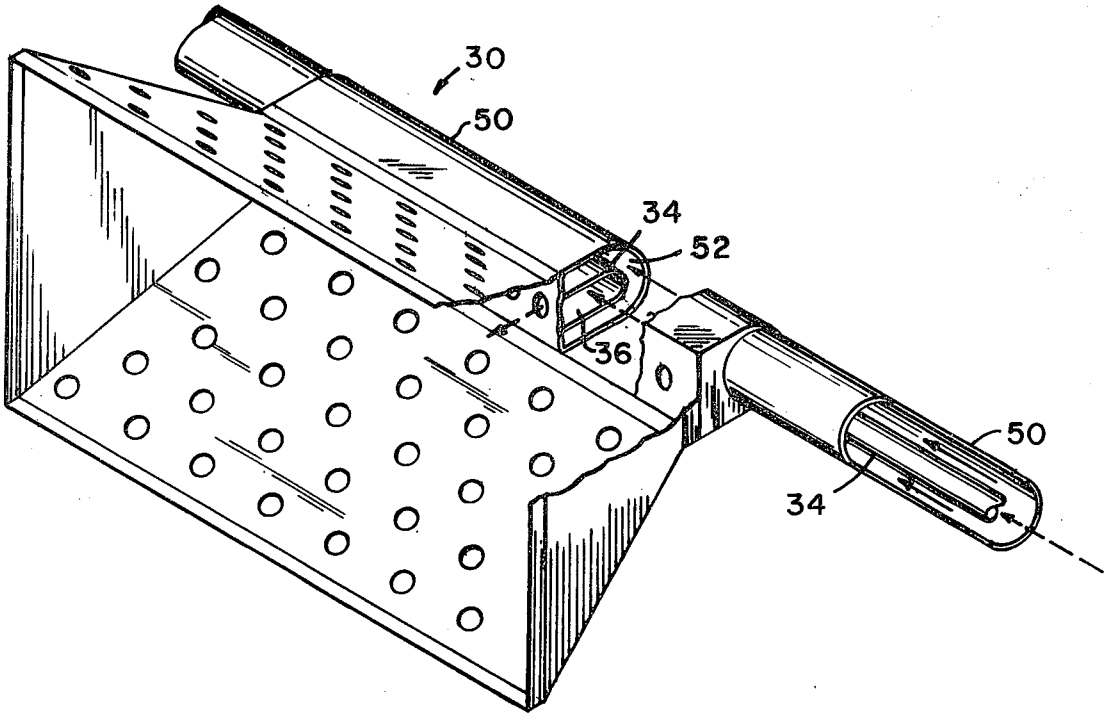
FIG. 3 is an enlarged perspective view, partly in section, of the preferred embodiment of the burner assembly of the present invention.

FIGS. 2 and 3 show the detail of the type of incinerator burner to which the present invention is directed. Each burner assembly 30 comprises an axially elongated conduit 34 defining a fuel gas passage 36 which is in flow communication with fuel gas supply header 38. The fuel gas supply conduit 34 has a major access line transverse to the direction of the flow of the process gas stream 3 through the incinerator housing 12 and an elongated forward wall 35 facing downstream with respect to the flow of the process gas stream 3 and facing the combustion chamber 18. A series of fuel gas injection port means 40 is provided along the length of the forward wall 35 opening into the fuel gas passage 36 of the gas supply conduit 34 to provide means for injecting fuel gas from the supply conduit 34 into the chamber 18.

Mixing plate means 42 and 44 extend forwardly from adjacent the side of the fuel gas supply conduit forward wall 38 along opposite sides of the fuel gas injection ports 40 and thence extend obliquely forward and outward in divergent relationship at an acute angle so as to define a forwardly widening trough-shaped mixing space 46 therebetween adjacent and immediately downstream of the fuel gas injection ports 40. A plurality of apertures 48 are provided in each of the mixing plates 42 and 44 so that the process gas stream 3 flowing past the burner assembly 30 is directed therethrough into the trough-shaped mixing space 46 formed between the mixing plates 42 and 44 adjacent and immediately downstream of the fuel gas injection ports 40.

The foregoing brief description of the burner assemblies 30 is considered sufficient for purposes of this application to describe the basic type of burner commonly employed in fume incinerators and to which the present invention is directed. For a more complete discussion of burners of this type, reference should be made to U.S. Pat. Nos. 3,297,295, 3,051,464 and reissue 25,626 thereof.

In accordance with the present invention, a second axially elongated conduit 50 is disposed in spaced relationship with the fuel gas supply conduit 34 with its major axis lying parallel to the major axis of the fuel gas supply conduit 34 so as to define therebetween a cooling gas flow passage 52 along the length of the fuel gas supply conduit. The cooling gas flow passage 52 has an inlet at one end which is connected in flow communication with a cooling gas supply header 54 whereby cooling gas may be passed through the cooling gas flow passage 52 along the entire length of the fuel gas supply conduit 34 so that the fuel gas traversing the fuel gas supply conduit 34 is shielded from the high temperature process gas stream 3 flowing past the burner assembly 3. An outlet 56 is provided at the opposite end of the cooling gas supply conduit 52 for venting the cooling gas after it has traversed the cooling gas flow passage 52 around the fuel gas supply conduit 34.

The cooling gas utilized may be, but is not limited to, ambient air or on preheated process gas. If air is utilized as the cooling gas, ambient air from the supply header 54 is passed through the cooling gas passage 52 over the fuel gas supply conduit 34 and vented through outlet 56 of the cooling gas supply conduit 52 to the atmosphere. If on the other hand, as preferred, unpreheated process gas if utilized as the cooling gas medium, unpreheated process gas 1 is supplied from a point upstream of the inlet 24 to the heat exchanger 20 and directed through supply conduit 58 to the cooling gas header 54. The unpreheated process gas then passes from the cooling header 54 through the cooling gas flow passage 52 over the surface of the fuel gas supply conduit 34 and out the outlet 56 to the cooling gas flow passage 52 back into the process gas stream leaving the heat exchanger 20 and being supplied to the gas inlet plenum 14. In this manner, the process gas stream itself is utilized to shield the fuel gas from the preheated process gas stream.

There has been provided therefor, in accordance with the present invention, a fume incinerator and a burner assembly wherein the process gas stream to be incinerated can be preheated to very high temperatures without worry that the fuel gas being supplied to burners disposed within the high temperature process gas stream will overheat and coke the inside surfaces of the fuel gas supply conduit.

Although the burner assembly of the present invention is described herein as applied to a fume incinerator wherein a preheated process gas to be incinerated is passed over a plurality of burner assemblies housed within the incinerator, it will be appreciated by those skilled in the art that the burner assembly of the present invention maybe readily adapted, with or without modification, for other incineration applications such as a gas stack incinerator wherein a single burner assembly is disposed in a process gas stream being vented through a stack to the atmosphere to burn any obnoxious fumes contained therein. Therefore, it is intended by the appended claims to cover all modifications which fall within the true spirit and scope of the present invention as defined in the claims appended hereto.

I claim:

1. A fume incinerator for eliminating obnoxious fumes from a process gas stream comprising:

a. a housing defining therein a gas inlet plenum, a gas outlet plenum, and a combustion chamber therebetween;

b. heat exchange means disposed within said gas outlet plenum for passing the process gas containing the obnoxious fumes to be incinerated in indirect heat exchange relationship with the incinerated process gas leaving the combustion chamber so as to preheat the process gas being supplied to the incinerator, said heat exchange means having an inlet for receiving the process gas being supplied from a process gas supply means to the incinerator, a core through which the process gas being supplied to the incinerator is passed in heat exchange relationship with the incinerated process gas leaving the combustion chamber, and an outlet for exhausting the preheated process gas being supplied to the incinerator;

c. duct means interconnecting the outlet of said heat exchange means with said gas inlet plenum for providing a flow passage through which the preheated process gas passes from the outlet of said heat exchange means to said inlet plenum;

d. a plurality of burner assemblies disposed between said inlet plenum and said combustion chamber for incinerating the preheated process gas flowing from said inlet plenum into said combustion chamber, each of said plurality of burner assemblies comprising:

i. a first axially elongated conduit defining a fuel gas supply passage and having a major axis lying transverse to the direction of the flow of the process gas stream and an elongated forward wall facing downstream with respect to the flow of the process gas stream, said wall having fuel gas injection port means at a series of points along its length;

ii. mixing plate means extending forward from adjacent the sides of the fuel gas supply conduit in spaced relationship along opposite sides of the fuel gas injection ports and thence extending obliquely forward and outward in divergent relationship at an acute angle so as to define a forwardly mixing plate means extending forward from adjacent the sides of the fuel gas supply conduit in spaced relationship along opposite sides of the fuel gas injection ports and thence extending obliquely forward and outward in divergent relationship at an acute angle so as to define a forwardly widening trough-spaced mixing space therebetween adjacent and immediately downstream of the fuel gas injection ports, said mixing plate means having a plurality of apertures therein through which process gas flowing past the burner assembly is directed into the trough-shaped mixing space adjacent and immediately downstream of the fuel gas injection ports; and iii. a second axially elongated conduit disposed in spaced relationship with the first conduit and having a major axis lying parallel to the major axis of the first conduit so as to define therebetween a cooling gas flow passage along the length the fuel gas supply conduit whereby the fuel gas traversing the gas supply conduit is shielded from the high temperature process gas stream flowing past the burner assembly;

e. means for supplying fuel gas to the fuel gas supply conduit of each of said plurality of burner assemblies;

f. means connected to the process gas supply means upstream of the process gas inlet to said heat exchanger for supplying process gas from a point upstream of the inlet to said heat exchange means to the cooling gas flow passage of each of said plurality of burner assemblies; and g. means for exhausting the process gas supplied to the cooling gas flow passage of each of said plurality of burner assemblies including exit means connected to said gas inlet plenum for supplying said exhausted process gas to said gas inlet plenum upstream of said plurality of burner assemblies for subsequent incineration in the combustion chamber.

* * * * *